United States Patent [19]

Clark

[11] 4,290,328

[45] Sep. 22, 1981

[54] RATCHET HANDLE

[75] Inventor: Clyde C. Clark, Davenport, Iowa

[73] Assignee: Vermont American Corp., Louisville, Ky.

[21] Appl. No.: 121,829

[22] Filed: Feb. 15, 1980

[51] Int. Cl.[3] ..... B25B 13/46

[52] U.S. Cl. ..... 81/62; 145/75

[58] Field of Search ..... 81/60–63.2, 81/125; 145/71, 72, 75, 76; 192/43.1

[56] References Cited

U.S. PATENT DOCUMENTS

| | | | |
|---|---|---|---|
| 455,484 | 7/1891 | Fosburgh et al. | 81/63 |
| 778,115 | 12/1904 | Coddington | 81/63 |
| 791,599 | 6/1905 | Abolt | 81/63 |
| 2,833,548 | 5/1958 | Clark | 81/125 |
| 3,356,117 | 12/1967 | Wagner | 145/71 |
| 3,475,999 | 11/1969 | Roberts et al. | 145/71 |

FOREIGN PATENT DOCUMENTS

| | | | |
|---|---|---|---|
| 2334471 | 12/1977 | France | 81/60 |

*Primary Examiner*—James L. Jones, Jr.

*Attorney, Agent, or Firm*—Wood, Herron & Evans

[57] ABSTRACT

A ratchet handle includes a composite ratchet gear having a passageway therethrough and an inner sleeve within an enlarged portion of the passageway. The passageway has a smaller flat-sided portion forming a tool holding aperture aligned with an internal tool holding aperture in the inner sleeve. A tool holding washer is captured between the inner sleeve and the ratchet gear. Improved positive control apparatus includes a slider control device moving yieldable detents formed by yieldable convoluted plate and projections on a stationary cover plate.

14 Claims, 6 Drawing Figures

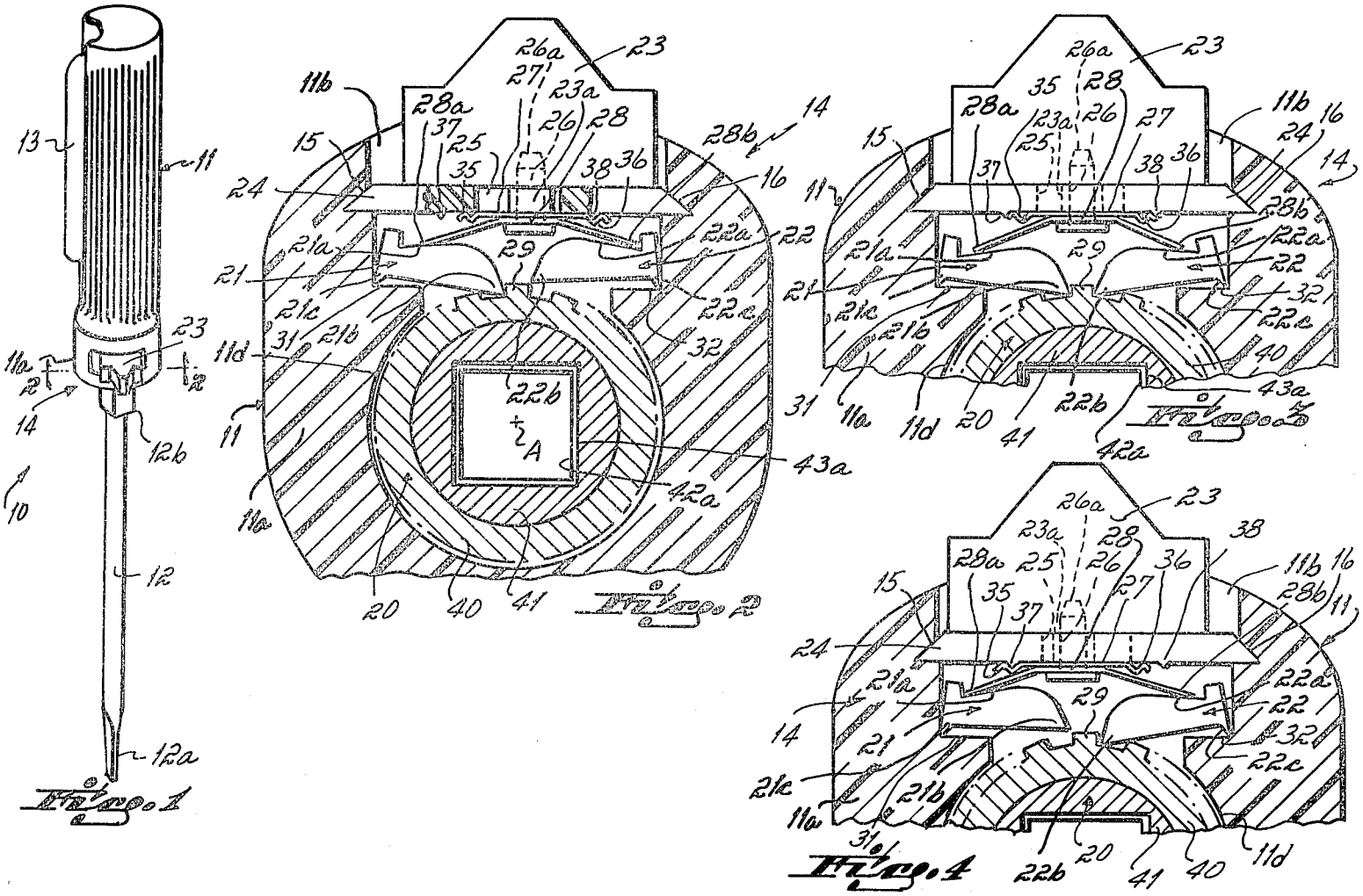

RATCHET HANDLE

This invention relates to ratchet tools, and more particularly to ratchet handles for holding and operating tools.

Ratchet handles for tools such as screwdrivers, nut drivers, and sockets are well-known. For example, in U.S. Pat. No. 3,356,117, a tool handle includes a ratchet gear, pawls, and an eccentric control button for moving the pawls into and out of engagement with said gear to prevent or to permit rotation of the gear and a tool held thereby, in a desired direction, as the handle is turned.

This particular device, while providing a ratcheting tool handle, has several disadvantages. For example, the control button is rotatable in the handle through an angle to position the pawls, but it does not appear to have positive stops for extreme positions of the control button and the interior pawls. It is thus more difficult to feel the various positions of the control button, and thus, the pawls positively.

A second disadvantage of the device disclosed in patent lies in the construction and assembly of the ratchet gear which requires a relatively large variety of machining and assembling operations, and thus is relatively expensive to produce. Such operations are required, for example, to produce the bearing surfaces, the extensive square tool holding passageway in the gear ring, and the circular groove for the tool holding washer. Moreover, a special clip or retainer must be used to hold the gear in the handle.

It is to the control apparatus and the ratchet gear, and assembly methods for each of these, to which the improvements of the invention herein, are primarily directed.

Specifically, it has been desireable to provide an improved ratchet tool handle having a control member with positive control positions which are readily and positively found by simple movements from one position to another, which indicates pawl position by positive stops, and which are yieldably retained. Further, it has been desireable to provide an improved ratchet tool handle having an improved ratchet gear and tool holding structure which can be inexpensively manufactured and easily assembled.

To these ends, an improved operating control is provided in the form of a slider and underlying detent means for yieldably holding the slider in one of three positions. Specifically, a cover plate over the pawls is provided with a slot. A post or boss, extending from the slider, extends through the slotted cover, and a yieldable detent plate, and a spring means for engaging and moving the pawls into and out of engagement with the ratchet gear, are secured to the slider by means of a rivet extending into the post. The cover plate is provided with ridges for cooperating with corrugations or convolutions on the detent plate for providing yieldable slider detent positions. Positive stops are provided through the engagement of the spring means with the respective pawls when the pawls are respectively lifted to their raised positions out of engagement of the gear.

Further, the invention provides an improved ratchet gear having two basic parts, and a resilient tool holding washer secured between them. Specifically, an elongated ring gear having a two-part passageway therethrough, defining a shoulder therein, and an internal sleeve within a large diameter first portion of the passageway and fixed to the ring gear form a composite ratchet gear. The sleeve has a multi-sided tool holding aperture therein, and captures the resilient washer against the shoulder in the passageway for providing a tool holding means within the gear. The tool holding aperture is aligned with the multi-sided second portion of the passageway. This improvement provides an easily assembled three part ratchet gear and tool holder which requires less expensive manufacturing operations than the prior gear described above.

During manufacture, the gear ring is mounted on a mandrel, the washer is positioned over the mandrel, and the internal sleeve is press-fitted into the internal sleeve, at the same time fixing the sleeve to the gear and capturing the resilient washer between the sleeve and the shoulder in the gear ring. Thereafter, the assembled ratchet gear is passed through a resilient reduced mouth portion in the handle, the mouth capturing the gear therein.

Accordingly, the invention provides an improved ratcheting tool handle having both an improved control and an improved composite ratchet gear, together with improved assembly methods.

These and other objects and advantages will become readily apparent from the following detailed description of a preferred embodiment of the invention and from the drawings in which:

FIG. 1 is a prespective view of a preferred embodiment of a ratchet tool handle embodying the invention;

FIG. 2 is an enlarged cross-sectional view taken along lines 2—2 of FIG. 1, with the tool omitted;

FIG. 3 is a variation of FIG. 2 showing the pawls in a fully locked position;

FIG. 4 is a variation of FIGS. 2 and 3 showing the control and pawls in a different position;

Figure 5:
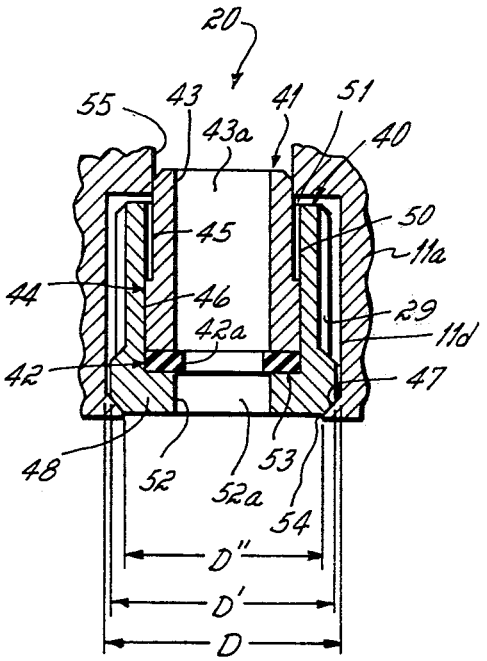
FIG. 5 is a cross-sectional view of the composite ratchet gear of the invention.
Figure 6:
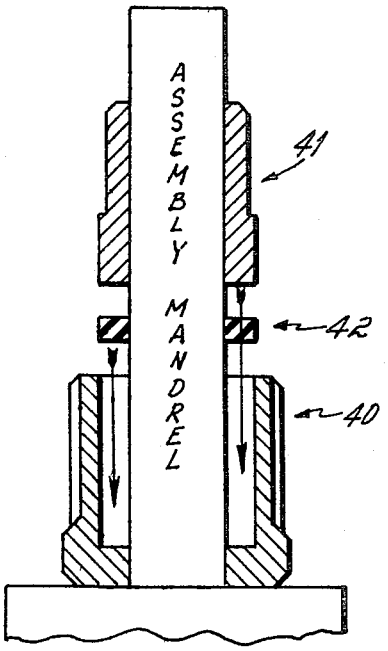
FIG. 6 is an illustrative view of the assembly of the internal sleeve, the washer and the gear ring.

Turning now to the drawings, there is shown in FIG. 1 a ratchet tool 10 having a ratchet handle 11 and a tool 12 mounted therein. Tool 12 can be a screwdriver blade as shown, a nut driver, or any other tool which can be conveniently held or used by means of the handle 11.

Basically, the tool 12 has an operating end **12*a* and a multi-sided rearward end 12*b* for mounting in the handle. The preferred handle itself is elongated and may be provided with a rotatable torque arm 13** which can be swung out from the handle to increase the application of torque by the tool.

A forward end of the handle is provided with a two-way ratcheting means 14 (not shown in detail in FIG. 1). The ratcheting means 14 is provided for locking the tool against rotation in both directions with respect to the handle, or for locking the tool against rotation in one direction or the other with respect to the handle while at the same time permitting rotation between the handle and tool in the opposite direction. Thus, when the tool is placed on a screw or the head of a bolt, for example, the handle may be turned in one direction, turning the tool and the workpiece, and the handle may be rotated in another direction without removing the tool from the workpiece, and while the tool and the workpiece remain stationary.

Turning now to the further details of the invention, a cross-sectional view of the ratcheting means 14 is shown in FIG. 2. Handle 11 has a protruding end portion **11*a* (FIG. 2) in which the ratcheting means is located. Primarily, the ratcheting means includes a ratchet gear 20, pawls 21 and 22, and a control slider 23. Control slider 23 is mounted within an aperture 11***b* of the end 11*a*. The slider 23 is mounted on cover plate 24, which is provided with an elongated slot 25 therein. The slot 25 extends in the same longitudinal direction as the cover plate, across the aperture 11*b*. It will be noted that the position of the slider 23 within the aperture 11*b* is the same for FIGS. 1 and 2. Different positions of the slider are shown in FIGS. 3 and 4, as will be discussed.

Returning now to FIG. 2, a post or boss 23*a* comprises a protruding integral part of the slider and extends through slot 25 in the cover plate. A yieldable detent plate 27 is secured to the post on the opposite side of the cover plate by means of a rivet 26 disposed in bore 26*a*. Additionally, spring means 28 is also secured to the post, beneath the yieldable detent plate 27, by the rivet. The spring means 28 has two ends 28*a* and 28*b*, respectively, which extend downwardly from beneath the slider 23 and into engagement with the pawls 21 and 22.

As shown in FIG. 2, the pawls 21 and 22 have upper surfaces 21*a* and 22*a*, respectively, which are engaged by the ends 28*a* and 28*b* of the spring means 28. The pawls also have operative ends 21*b* and 22*b*, respectively, which are selectively operable for engagement with the teeth 29 on the ratchet gear 20. As shown in FIG. 2, the rearward ends 21*c* and 22*c* of the pawls are constructed so that the pawls pivot on shoulders 31 and 32 of the aperture 11*b*. Thus, as will be appreciated, the ends 21*b* and 22*b* of the respective pawls can be pivoted into and out of engagement with teeth 29 of the ratchet gear 20. Moreover, when the slider 23 is moved to lift a pawl from the gear 20, the rear end of the pawl contacts the side of the aperture 11*b*. This engagement, together with the engagement of the respective spring ends, provides a positive stop, in position, for the slider control.

In FIG. 2, slider 23 is shown moved to the right. In this condition, the end 28*b* of the spring means has engaged the pawl 22 and has tilted it upwardly so that end 22*b* of the pawl is not in a position to engage the teeth 20 of the ratchet gear 20. On the other hand, the end 28*a* of the spring means has moved to the right along surface 21*a* of the pawl 21 and thus has pivoted pawl 21 so that its end 21*b* is dropped into engagement with teeth 29 of the gear ring. Under these conditions, the gear ring is prevented from rotating, with respect to the handle, in a counterclockwise direction about the axis A. The gear ring is moveable in a clockwise direction without interference from the pawls, the pawl 21 merely yielding, by virtue of the yieldable pressure of the spring means 28, to permit clockwise rotation of the ratchet gear 20 within the handle 11.

Viewed in another way, if the ratchet gear 20 were connected to a tool such as tool 12 in FIG. 1 and that tool was operating on a workpiece, the handle 11, as viewed in FIG. 2, could be turned counterclockwise with respect to the ratchet gear 20, but could not be turned clockwise without turning the ratchet gear 20 and tool 12 if such a tool were mounted within the ratchet gear.

Considering the further details of controls for the pawl, it will be appreciated that the yieldable detent plate has corrugations or transverse convolutions 35 and 36 on each thereof. At the same time, it will be appreciated that the cover plate 24 is provided with ridges 37 and 38, respectively. The ridges are parallel to the convolutions 35 and 36 formed in the yieldable detent plate, and the ridges are also essentially transverse to the elongation of the slot 25 in the cover plate. As shown in FIG. 2 then, when the slider 23 is moved to the right, the convolution 36 is moved to such an extent that an inner portion of the convolution falls over and envelops the ridge 38. This provides a positive detent "feel" to the position of the slider and to the respective positions of the pawls 21 and 22, as shown in FIG. 2 and is in addition to the positive stop described above.

Considering now FIG. 3, the slider 23 has been moved from right to left to a central position. In this position, the outer ends of the respective convolutions 35 and 36 each engage a respective ridge 37 and 38. This provides a positive "feel" for the slider 23 in its central position. When slider 23 is in this position, the post 26 is also in its central position with respect to the slot 25. Moreover, it will be appreciated that the spring means 28 has its ends 28*a* and 28*b* engaging each of the pawls 21 and 22 in exactly the same position and inside their respective pivot points. Accordingly, the ends 21*b* and 22*b* of the respective pawls are both biased downwardly into a position where they engage each side of a tooth 29 of the ratchet gear 20. Obviously pawl 21 was already in its engaged position as shown in FIG. 2 and the new position of spring end 28*a*, correlating to the central position of the slider still biases pawl 21 downwardly. Thus, when the slider is in the central position, as shown in FIG. 3, each of the pawls operatively engage the tooth 29 and prevent rotation of the ratchet gear 20 in any direction with respect to the handle 11.

Turning now to FIG. 4, the slider 23 has been moved to the extreme left, such that the post 26 is also moved to the left of the slot 25. In this position, an inner portion of the convolution 35 envelops the ridge 37 and provides a positive detent "feel" for this position of the slider. This is in addition to the positive stop occurring through engagement of the spring end 28*a* against the rear end of pawl 21 which is pivoted against aperture 11*b*. Thus, the end 28*a* of the spring means 28 has moved along pawl 21 to a position where it pivots the pawl upwardly and out of contact with any tooth 29 on the ratchet gear 20.

At the same time, end 28*b* of the spring means has been moved further to the left from its central position and continues to bias the pawl 22 downwardly such that end 22*b* of the pawl is yieldably held in engagement with tooth 29 of the ratchet gear 20.

In this position, the operation of the relative rotation between the handle gear and the ratchet gear 20 is directly opposite to that as described in FIG. 2 above. Specifically, as viewed in FIG. 4, the ratchet gear is free to rotate in a counterclockwise direction with respect to the handle 11, but is prevented from rotating in a clockwise direction with respect to handle 11 by the pawl 22. Alternately stated, of course, the handle 11 is free to rotate in a clockwise direction with respect to the ratchet gear 20, assuming that it is stationary, but the handle 11 is not free to rotate in a counterclockwise direction with respect to a stationary ratchet gear 20, and will turn any tool held in the ratchet gear.

Of course, it will be appreciated that each of the pawls are constructed such that their rearward ends and the areas near portions 21*c* and 22*c*, respectively, are disposed to engage the sides of aperture 11*b* and thus, provide respective positive stops, when in position between the ratchet gear 20 and the handle 11, for driving the gear 20 when the handle is turned.

Accordingly, the user of the ratchet handle 11 simply attaches a tool to the handle and operates the slider 23 to the appropriate position for applying torque. He then twists the handle against the stationary tool, to drive the workpiece. He may then, without regripping, return or reverse twist the ratchet handle to its starting position, while the tool and workpiece remain stationary.

The control slider 23 is operative in a central position to prevent any rotation of the tool with respect to the handle by means of the operation of the ratchet means 14 and the gear 20. Alternatively, the slider 23 can be moved to either side of the central position to permit ratcheting of the tool handle in one direction and driving of the ratchet gear 20 by moving the tool handle in the other direction.

Turning now to the details of the ratchet gear 20, these are perhaps best seen in FIG. 5 where the ratchet gear 20 comprises a composite ratchet gear including a gear ring 40, an internal sleeve 41, and a tool holding flexible washer 42. Gear ring 40 has an enlarged forward end 48, of a major diameter D' (FIG. 5), and rearwardly from which teeth 29 extend. As best seen in FIGS. 2 and 5, the inner or internal sleeve 41 has a multi-sided tool holding aperture 43 therein. In FIG. 2, this aperture is depicted to be in the form of a square, although it could, of course, be hexagonal, octagonal or any other form of flat-sided or keyed aperture, for example. Moreover, it will be seen that the internal or inner sleeve 41 has an outer cylindrical surface, comprising a reduced diameter portion 45 and an enlarged diameter portion 46. Moreover, it will be seen that the internal sleeve 41 is positioned within a passageway 50 of the gear ring 40, with the enlarged portion 46 forward of the reduced portion 45.

Passageway 50 of gear ring 40 has two portions, a first relatively large diameter portion 51 and a second multi-sided portion 52. The second multi-sided portion 52 forms, with the portion 51, a shoulder 53 in the passageway 50.

It will also be appreciated that the diameter of the large portion 51 of passageway 50 is significantly equal to the diameter of the enlarged diameter portion of the inner sleeve 41. These surfaces and diameters are selected so that the sleeve 41 fits within the gear ring 40 with a press or friction fit. Moreover, and as shown in FIGS. 2 and 5, for example, the inner sleeve 41 and the gear ring 40 are disposed with respect to each other so that the multiple sides of aperture 43 and of position 52 lie in the same respective planes. That is, side 43*a*, for example, lies in approximately the same plane as side 52*a*. Thus, a tool 12, with a square shank, can be inserted into the multi-sided aperture 52 and through the multi-sided tool holding aperture 43 of the inner sleeve 41. The tool is thus secured against rotation with respect both to the inner sleeve 41 and the gear ring 40.

It will also be appreciated that the flexible washer 42 has a corresponding multi-sided aperture 42*a* which extends into the elongated tool holding aperture formed by the aperture 43 and the aperture 52. When the square shank 12*b*, for example, of a tool is inserted then into the apertures 52 and 43, the washer 42 flexes and binds the tool shank tending to hold the tool in position with respect to longitudinal movement within the gear ring 40 and the inner sleeve 41.

Finally, inner sleeve 41 extends slightly past the gear ring 40 as shown in FIG. 5. The protruding rear end of the inner sleeve 41 fits within a rearward bone 55 of the handle portion 11*a* to support the ratchet gear 20 for rotation.

During assembly of the tool handle 11, it is then only necessary to mount the gear ring 40 on a square mandrel, to position the washer 42 on the mandrel with the flat sides of the washer engaging the sides of the mandrel in alignment with the flat sides of the aperture 43, and then to press fit the inner sleeve 41 over the gear ring 40, the press or friction fit occurring between the enlarged diameter portion 46 of the inner sleeve 41 and the large diameter portion of the gear ring 40. The inner sleeve and the gear ring are thus disposed in fixed, aligned relationship to each other and the multi-sided tool holding aperture 53 is maintained in appropriate alignment with the multi-sided aperture 52, the respective sides being in approximately coplannar relationship with respect to each other.

In order to assemble the complete handle, it is only necessary to use, for example, a molded handle 11 of plastic, resin, or synthetic material of slight resilience. The handle is constructed to provide the aperture 11*b* as shown and a gear receiving bore 11*d* having a diameter D as shown, for example, in FIG. 2.

Diameter D of bore 11*d* (FIG. 5) is only slightly larger than the major diameter D' of gear ring 40. The bore 11*d* is provided with a resilient mouth 54 having a slightly decreased diameter D'' at the very entrance of the bore at the end 11*a* of the handle. Diameter D'' is slightly smaller than the major diameter D', such that the ratchet gear 20, in its assembled condition, can be pressed into the bore 11*d*, and then held therein by means of the slightly reduced mouth 54, which simply enlarges during passage of gear 40 but contracts and prevents undesireable release of the gear ring 40 therethrough after assembly. It will be appreciated that gear ring 40 also includes chamfer 47 for engagement for the reduced end of the bore 11*d* when the gear ring 40 is in place. Also, the rear ends of sleeve 41 and of gear ring 40 are chamfered to aid assembly in handle end 11*a*.

Once the gear ring 40 and its assembly are inserted into the handle, the pawls 21 and 22 may be positioned in the aperture 11*b* and the cover, with assembled slider components, then positioned in appropriate grooves 15 and 16. The spring means 28, yieldable detent plate 27, cover plate 24 and control slider 23 are held together by means of a rivet 26 fitting into a bore 26*a* in the control slider 23. As shown in FIGS. 2–4, this bore extends downwardly from the slider and through post or boss 23*a* disposed in aperture 25 of the cover plate. The rivet 26 fits in the bore to secure the spring means and detent plate to the control slider on an opposite side of the cover plate. During assembly, the cover plate 24 is flexed until it is moved into appropriate position in grooves 15 and 16 within the aperture 11*b*.

Accordingly, it will be appreciated that the invention provides an improved control means for a ratcheting tool handle, as well as an improved composite ratchet gear. The control means, operated by movement of the slider 23, provides positive pawl movement and positive stops. The slider is yieldably held in each of the positions by the yieldable detent plate 27 and its operation with the respective ridges 37 and 38. Moreover, it will be appreciated that it is now unnecessary to machine a washer holding groove within the gear ring 40, and it is further unnecessary to machine particular bearing surfaces on the gear ring 40, as the complete ratchet gear 20 is simply maintained in the bore 11*d* of the handle. Moreover, by utilization of the inner sleeve 41 and the cooperation between the sleeve and the gear ring 40, the flexible washer 42 is easily assembled, aligned and maintained in proper position. It will further be appreciated that because of the alignment of the tool holding apertures 52 and 43, the tool is positively held, not only by the fact that the sleeve 41 is press fit into the gear ring 40, but also by the fact that the tool positively engages the multi-sided aperture 52 of the gear ring.

Having now described a preferred embodiment of the invention, many modifications and alterations will become readily apparent to those of ordinary skill in the art, without departing from the scope of this invention, and the applicant intends to be bound only by the claims appended hereto.

I claim:

1. A ratchet tool handle of the type having a rotable ratchet gear means, pawl means for selectively and operatively engaging with and disengaging from said ratchet gear means, and control means for moving said pawl means into and out of engagement with said ratchet gear means, the improvement wherein:

said ratchet gear means includes a gear ring having teeth on an exterior side thereof, a passageway through said gear ring, said passageway having a first cylindrical portion of predetermined diameter, and a second portion having at least one flat side, said diameter being greater than the length of said side, and an inner sleeve disposed within the first cylindrical portion of said passageway in fixed relation with said gear ring and having a tool holding aperture therein.

2. Apparatus as in claim 1 wherein said first and second portions are coaxial and adjacent, forming a shoulder in said passageway, and said apparatus further including a resilient ring in said passageway between said shoulder and said inner sleeve, said ring having an inner surface extending inwardly of said tool holding aperture.

3. Apparatus as in claim 1, wherein said tool holding aperture has at least one flat side.

4. Apparatus as in claim 3 wherein said tool holding aperture and said passageway at said second portion correspond in shape, said flat sides lying in respectively a common plane.

5. A ratchet tool handle of the type having a rotatable ratchet gear means, pawl means for selectively and operatively engaging with and disengaging from said ratchet gear means, and control means within an aperture of said handle for moving said pawl means into and out of engagement with said ratchet gear means, the improvement wherein:

a cover plate extending across said aperture and having a slot therein, a slider in said aperture on an outer side of said cover plate and having a post extending through said slot, a yieldable detent plate connected to said post for sliding movement in said handle, and spring means connected to said post and disposed in operative engagement with said pawl means for selectively engaging and disengaging said pawl means with said ratchet gear means.

6. Apparatus as in claim 5 including detent means on a lower side of said cover plate and in operative engagement with said detent plate.

7. Apparatus as in claim 6 wherein said detent means comprise a pair of ridges, each proximate a respective end of and disposed transverse to said slot.

8. Apparatus as in claim 7 wherein said detent plate includes transverse convolutions proximate respecting ends thereof, said convolutions being parallel to and selectively yieldably engaging said respective ridges.

9. Apparatus as in claim 8 wherein said slider is movable through three positions, one of which comprises a central position in which each of said convolutions engage a respective ridge and said pawl means engage said ratchet gear preventing rotation thereof, in any direction, with respect to said handle.

10. Apparatus as in claim 9 including two side positions located respectively on opposite sides of said central position, one of said convolutions of said detent plate engaging at an inner side one of said ridges when said slider is in one of said side positions and another of said convolutions engaging, at an inner side, another of said ridges when said slider is in another of said side positions.

11. Apparatus as in claim 10 wherein said pawl means comprises two pawls, both of said pawls engaging said ratchet gear means when said slider is in said central position, and wherein one of said pawls engages said ratchet gear means and the other of said pawls is disengaged therefrom, when said slider is in one of said side positions to permit rotation of said ratchet gear means in one direction with respect to said handle and to prevent rotation thereof in another direction with respect to said handle.

12. A ratched tool handle of the type having a rotatable ratchet gear means, pawl means for selectively and operatively engaging with and disengaging from said ratchet gear means, and control means for moving said pawl means into and out of engagement with said ratchet gear means, the improvement wherein:

said ratchet gear means includes a gear ring having teeth on an exterior side thereof, a passageway through said gear ring, and an inner sleeve in said passageway in fixed relation with said gear ring and having a tool holding aperture therein, said inner sleeve extending rearwardly of said gear ring for supporting said ring for rotation within said handle.

13. Apparatus as in claim 12 wherein said handle includes a housing portion for said ratchet gear means and said control means, said housing portion having a forward mouth of lesser diameter than at least portions of said gear ring, and a rearward bore for supporting a rearward end of said inner sleeve.

14. A ratchet tool handle of the type having a rotatable ratchet gear means, pawl means for selectively and operatively engaging with and disengaging from said ratchet gear means, and control means for moving said pawl means into and out of engagement with said ratchet gear means, the improvement wherein:

said ratchet gear means includes a gear ring having teeth on an exterior side thereof, a passageway through said gear ring, said passageway having a first cylindrical portion and a second portion defined by at least one flat side, an inner sleeve in said cylindrical portion of said passageway in fixed relation with said gear ring and having a tool holding aperture of at least one flat side therein, and said at least one flat side of said tool holding aperture lying in a common plane with said at least one flat side of said second passage portion.

* * * * *